United States Patent [19]

Black

[11] 4,256,154

[45] Mar. 17, 1981

[54] BOTTLE WITH RETRACTABLE FUNNEL TOP

[76] Inventor: Steven Black, 10041 Jon Day Dr., Huntington Beach, Calif. 92646

[21] Appl. No.: 56,054

[22] Filed: Jul. 9, 1979

[51] Int. Cl.[3] ..... B65B 39/02; B65D 1/02; B67C 11/00

[52] U.S. Cl. ..... 141/98; 141/338; 215/31; 222/527

[58] Field of Search ..... 215/31, 1 C; 141/337, 141/98, 338, 340, 341, 342, 343; 222/527, 530; 220/85 SP

[56] References Cited

U.S. PATENT DOCUMENTS

| | | | |
|---|---|---|---|
| 365,560 | 6/1887 | Adwen | 141/341 X |
| 1,479,660 | 1/1924 | Fuller | 141/338 |
| 2,036,687 | 4/1936 | Fisher | 150/3 |
| 3,285,495 | 11/1966 | Colato | 229/43 |
| 3,579,652 | 5/1971 | Ericson | 141/337 X |
| 3,899,100 | 8/1975 | Rigand | 220/229 |
| 4,153,172 | 5/1979 | Biglobrzeski | 220/85 SP X |

FOREIGN PATENT DOCUMENTS

| | | | |
|---|---|---|---|
| 323277 | 7/1920 | Fed. Rep. of Germany | 141/338 |
| 41375 | 7/1915 | Sweden | 141/340 |

*Primary Examiner*—Allan N. Shoap
*Attorney, Agent, or Firm*—G. Donald Weber, Jr.

[57] ABSTRACT

There is shown and described a bottle having an integral, retractable funnel at the top or opening thereof. The retractable funnel is disposed within the bottle in normal operation but is extended from the bottle opening during a refill operation.

5 Claims, 3 Drawing Figures

BOTTLE WITH RETRACTABLE FUNNEL TOP

BACKGROUND OF THE INVENTION

1. Field of the Invention

This invention is directed to refillable bottles, in general, and to such bottles having integrally formed funnels associated with the openings thereof, in particular.

2. Prior Art

There are many known consumer utilizations of bottles which are refillable from other sources. For example, many cleaning solutions come in large containers for easy handling and storage. Smaller containers, e.g. bottles, are used in the every day use or application of the materials. For example, window cleaner or spray in the form of a liquid is stored in large containers having a size of a gallon or more. The ordinary applicator may contain a half pint or the like wherein the container is relatively easily handled by the user. Therefore, a large supply source is maintained for supplying the useful product but the actual applicator is maintained small for ready utilization.

When the applicator device is emptied, it is refilled from the storage container. However, in most cases the applicator bottle has a relatively small opening and/or neck at the top thereof. On the other hand, the storage container may have a much larger opening. Even if the storage container has an opening of substantially the same size and configuration as the applicator bottle opening, a significant chance of spillage occurs. In point of fact, spillage frequently occurs even though significant care and dexterity are exercised by the user. In the alternative, a funnel may be utilized in the refill operation. However, this has the disadvantage of requiring that a funnel be obtained or that the funnel have the appropriate size and configuration to accomodate both the refillable applicator bottle and the refill source container. The usual difficulties and problems which are encountered are well known to those in the art. In addition, where caustic chemicals are to be refilled, care must be given to thorough cleaning of the funnel prior to use.

PRIOR ART STATEMENT

A search of the prior art has been conducted and the following prior art has been discovered.

Re 14,688, Maiden, Dispensing Bottle which shows a bottle having a storage area in the bottom of the bottle for a receptacle such as a folded paper cup or the like.

U.S. Pat. No. 1,256,961, Welsh, Disappearing Funnel, which shows a collapsible funnel for use with a water cooled radiator or the like.

U.S. Pat. No. 1,373,722, Gustafson, Collapsible Funnel, which describes a collapsible funnel having a unique funnel configuration and structure which is used with an automobile radiator.

U.S. Pat. No. 1,408,865, Cowell, Collapsible Funnel, which shows a particular collapsible funnel that would be arranged in the radiator opening of an automobile.

U.S. Pat. No. 1,420,039, Horstkotte, Radiator Funnel, which shows a collapsible funnel which is carried by or within the neck of the radiator of an automobile.

U.S. Pat. No. 1,563,005, Allee, Collapsible Funnel, which is directed to a collapsible funnel having segmental staves which are connected together to form walls of a funnel which can be stored within a housing.

German Pat. No. 826,105, Sukatsch, which is directed to a collapsible funnel of unique configuration.

None of these patents shows an integral funnel-container arrangement nor do they indicate that the funnel is made of a flexible material.

SUMMARY OF THE INVENTION

The invention shown and described herein comprises a bottle or other container having a neck portion which is adapted to receive a cap or other suitable closure element. A funnel made of flexible material is integrally formed with and connected to the neck portion. The funnel is normally arranged to be inserted within the container and inside the neck portion thereof. A pull-tab is attached to the surface of the funnel and within the container. The funnel may be selectively withdrawn from the container by pulling on the pull-tab. Conversely, the funnel can be reinserted into and stored within the container merely by pushing the funnel into the container.

BRIEF DESCRIPTION OF THE DRAWINGS

In the several figures, similar components bear similar reference numerals.

DESCRIPTION OF THE PREFERRED EMBODIMENT

Figure 1:
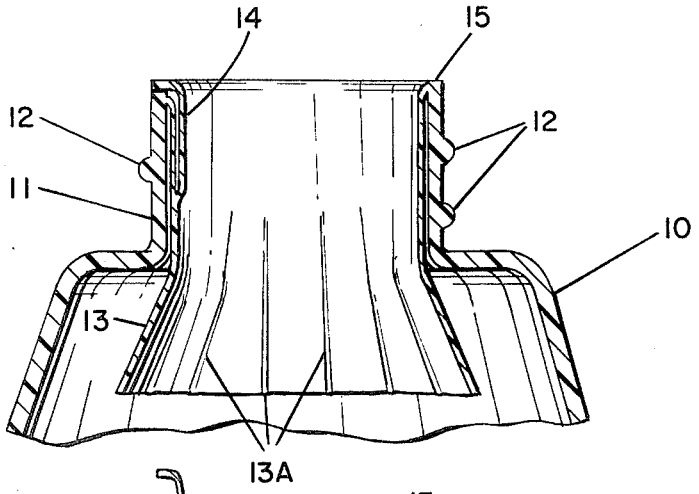
FIG. 1 is a cross-sectional view of the opening of a container having an integrally formed, retractable funnel associated therewith and stored therein.

Referring now to FIG. 1, there is shown a schematic representation of the top of a bottle or other suitable container 10. The container 10, as shown, represents the upper or top portion thereof. A neck 11 of suitable configuration is formed as a portion of the bottle in a standard fashion. In this embodiment, neck 11 includes the helically arranged ridges 12 which are used to effect a screw arrangement for the container 10. The screw top arrangement is such that a cap, spray device or the like can be screwed onto container 10 and affixed thereto for the appropriate purpose such as sealing the bottle, applying a spray mechanism or the like. An integral funnel 13 is provided in the container. The funnel may comprise a relatively thin, resiliently deformable, web-like member. As shown in FIG. 1, funnel 13 tends to expand at the free end thereof which, in this case, is stored internally of container 10. Funnel 13 is joined to the upper end of neck 12 at the outer edge 15 which abuts the appropriate attachment or cap applied thereto. Funnel 13 is integrally formed with the outer edge of neck 11 of container 10.

A pull-tab 14 is joined to the inner surface of funnel 13. In particular, the pull-tab, as shown in this embodiment, is somewhat elongated and extends a substantial distance into container 10 and is attached to the surface of funnel 13. In addition, the free end of pull-tab 14 is shown bent over and conformed to the outer edge or lip of neck 11. In some other embodiments, it may be desirable to have this free end arranged to fall within a suitable groove or aperture in lip 15 so that the screw down apparatus will meet appropriately with a uniplanar edge 15. Alternatively, the pull-tab 14 can terminate within the opening of funnel 13 or not depending upon the arrangements made between the bottle and screw-on apparatus.

Appropriate ribs 13A can be formed in funnel 13 to cause the funnel to inherently expand at the free end thereof. In addition, other strengthening configurations can be applied to the funnel. Conversely, ribs 13A can be eliminated and suitable folds or the like can be provided in funnel 13 to facilitate the folding, retractability and expandability of the funnel.

Figure 2:
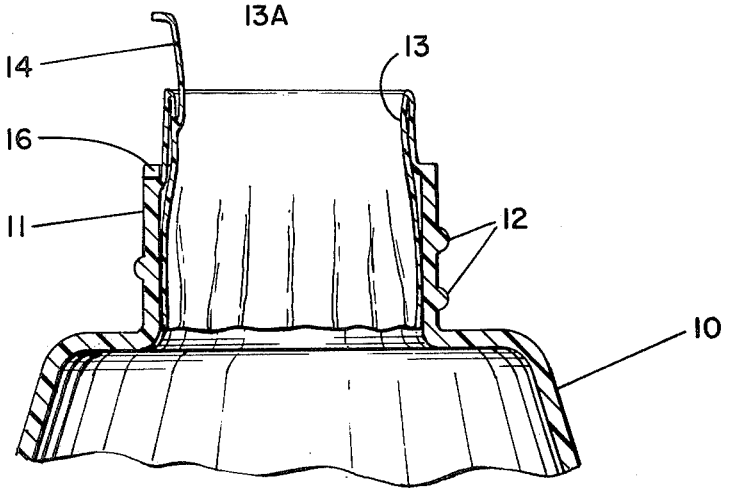
FIG. 2 is a cross-sectional view of the same with the retractable funnel partially removed.

Referring now to FIG. 2, it is seen that funnel 13 comprises a relatively thin membrane or web-like material which is partially withdrawn from container 10 at the neck 11 thereof. This withdrawal is, typically, effected by pulling on pull-tab 14 which is fastened to or integrally formed with funnel 13. In the embodiment shown in FIG. 2, a groove or aperture 16 is provided to receive and seat the free end portion of pull-tab 14.

Figure 3:
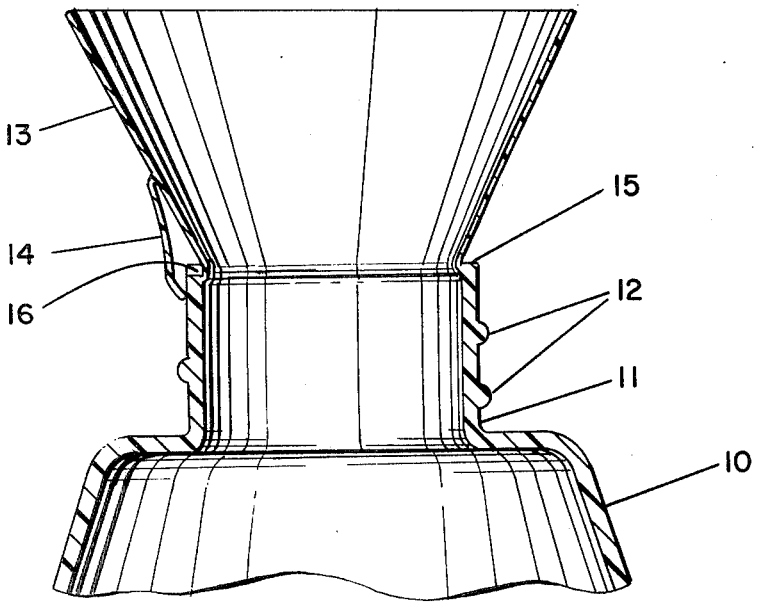
FIG. 3 is a cross-sectional view of the same with the funnel completely extended and ready for refill.

Referring now to FIG. 3, there is shown a cross-sectional view of the container with funnel 13 fully extended and ready for operation. It is seen that the interior end of funnel 13 is joined to and, preferably, formed integrally with the outer edge or surface of neck 11. This permits the funnel to be readily accessible at all times and also prevents any spillage between the funnel and container 10. The relative relationship of pull-tab 14 to funnel 13 is readily discernible in this view also.

After container 10 has been refilled from a supply source via funnel 13, funnel 13 is then returned to the position shown in FIG. 1 by merely pushing funnel 13 back into container 10 via neck 11.

While not so limited it is expected that the container and the integrally formed funnel will be fabricated of a plastic material. In particular, the funnel will be fabricated of a flexible plastic material. The integral container/funnel device can be fabricated by suitable blow-molding techniques which are known in the art.

Thus, there has been shown and described a preferred embodiment of the instant invention. The description and illustrations depict a preferred arrangement of the container and funnel formed as an integral unit. It is clear to those skilled in the art that various modifications can be made to the particular configuration of the funnel, the pull-tab and/or the container configuration. However, any such modifications which fall within the purview of the instant description are intended to be included therein as well. That is, the description is intended to be illustrative only and is not intended to be limitative of the invention. Rather, the scope of the invention is limited only by the claims appended hereto.

Having thus described a preferred embodiment of the invention, what is claimed is:

1. In combination, container means having an opening therein, funnel means formed as a unitary portion of said container means adjacent to said opening thereby to form a one-piece device, said funnel means formed such that said funnel means is flexible and selectively insertable into and removable out of said container through said opening wherein said funnel means is reversed upon itself in a collapsed state when inserted into said container, and flexible tab means joined to the outer surface of said funnel means intermediate the free end of said funnel means and the junction of said funnel means and said container means so that said funnel means can be removed from said container means to be in a set-up state by pulling on said tab means, said tab means extending into said container means when said funnel means is stored therein and arranged to conform to the funnel means when stored.

2. The combination recited in claim 1 wherein, said funnel means is formed of a resiliently deformable web member and is larger at its top open end when in said set-up state.

3. The combination recited in claim 2 wherein, said funnel means includes rib members for imparting strength thereto.

4. The combination recited in claim 1 wherein, said container means comprises a container having a neck adjacent to said opening, and said funnel means is integrally formed as a unitary part of said container at said neck.

5. The combination recited in claim 4 wherein, said neck includes threaded portions thereof to receive closure means.

* * * * *